US011091838B2

(12) United States Patent
Takata

(10) Patent No.: US 11,091,838 B2
(45) Date of Patent: Aug. 17, 2021

(54) SURFACE TREATMENT METHOD AND SURFACE TREATMENT APPARATUS

(71) Applicant: TOYOTA JIDOSHA KABUSHIKI KAISHA, Toyota (JP)

(72) Inventor: Satoshi Takata, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 8 days.

(21) Appl. No.: 16/383,921

(22) Filed: Apr. 15, 2019

(65) Prior Publication Data

US 2019/0345614 A1 Nov. 14, 2019

(30) Foreign Application Priority Data

May 14, 2018 (JP) ..... JP2018-092919

(51) Int. Cl.
*C23C 24/04* (2006.01)
*B05D 1/12* (2006.01)

(52) U.S. Cl.
CPC ..... *C23C 24/04* (2013.01); *B05D 1/12* (2013.01)

(58) Field of Classification Search
CPC ..... C23C 24/04; B05D 1/12
See application file for complete search history.

(56) References Cited

U.S. PATENT DOCUMENTS

2002/0006105 A1* 1/2002 Usami ..... G11B 7/26 369/275.4
2003/0232132 A1* 12/2003 Muehlberger ..... B05B 7/1693 427/180
2007/0178357 A1 8/2007 Vyas et al.
2011/0223053 A1* 9/2011 Jahedi ..... B22F 3/115 419/66
2015/0218704 A1* 8/2015 Verrier ..... G01N 13/00 427/180

FOREIGN PATENT DOCUMENTS

CN 101009385 A 8/2007
JP 2009-132945 A 6/2009
JP 2011-026670 A 2/2011
JP 2012-149314 A 8/2012
JP 2013-149625 A 8/2013

* cited by examiner

*Primary Examiner* — Robert A Vetere
(74) *Attorney, Agent, or Firm* — Sughrue Mion, PLLC

(57) ABSTRACT

Provided is a surface treatment method capable of reducing a cost and a time for production. In the surface treatment method, while a first nozzle (70) and a second nozzle (80) are disposed in the same chamber (1), the first nozzle (70) aerosolizes tin oxide particles and blows the aerosolized tin oxide particles on a stainless steel substrate (C10) at a first particle velocity V1. The second nozzle (80) aerosolizes tin oxide particles and blows the aerosolized tin oxide particles on the stainless steel substrate (C10) at a second particle velocity V2 higher than the first particle velocity V1.

3 Claims, 5 Drawing Sheets

SURFACE TREATMENT METHOD AND SURFACE TREATMENT APPARATUS

CROSS REFERENCE TO RELATED APPLICATIONS

This application is based upon and claims the benefit of priority from Japanese patent application No. 2018-092919, filed on May 14, 2018, the disclosure of which is incorporated herein in its entirety by reference.

BACKGROUND

The present disclosure relates to a surface treatment method and a surface treatment apparatus.

Japanese Unexamined Patent Application Publication No. 2013-149625 discloses a surface treatment method for removing a passive state film by bringing it into contact with a hydrogen ion and further applying gold plating.

SUMMARY

It has been necessary for the above-described surface treatment method to reduce a cost for production since gold (Au) is used. Further, it has been necessary to reduce a time for production since a process of, for example, washing a plating solution away is required.

The present disclosure reduces a cost and a time for production.

A first exemplary aspect is a surface treatment method, in which while a first nozzle and a second nozzle are disposed in the same chamber, the first nozzle aerosolizes tin oxide particles and blows the aerosolized tin oxide particles on a stainless steel substrate at a first particle velocity V1, and then the second nozzle aerosolizes tin oxide particles and blows the aerosolized tin oxide particles on the stainless steel substrate at a second particle velocity V2 higher than the first particle velocity V1.

With such a configuration, blowing the tin oxide particles by the first nozzle removes the passive state film of the stainless steel substrate. Then, the second nozzle blows the tin oxide particles so that a tin oxide film is formed on the stainless steel substrate. Both of the removal of the passive state film and the forming of the tin oxide film are carried out similarly by blowing the tin oxide particles. Accordingly, it is easy to remove the passive state film and form the tin oxide film successively in the same chamber. Therefore, after the removal of the passive state film, the cost and the time for production can be reduced while oxidizing a surface of the stainless steel substrate is prevented.

Further, a kinetic energy of the tin oxide particles blown by the first nozzle is between 70 and 260 atto J, and a kinetic energy of the tin oxide particles blown by the second nozzle is between 1100 and 2200 atto J.

With such a configuration, when a kinetic energy of the tin oxide particles blown by the first nozzle is 70 atto J or higher, the passive state film can be removed sufficiently. Further, when this kinetic energy is 260 atto J or lower, a removing efficiency of the passive state film is favorable. Further, when a kinetic energy of the tin oxide particles blown by the second nozzle is 1100 atto J or higher, most of the tin oxide particles are sufficiently destroyed on the surface of the stainless steel substrate, and thereby a tin oxide film can be formed with favorable film-forming efficiency. Further, when this kinetic energy is 2200 atto J or lower, the tin oxide particles are prevented from aggregating with each other, and thereby the favorable film-forming efficiency is maintained.

Another exemplary aspect is a surface treatment apparatus including a first nozzle and a second nozzle, in which while the first nozzle and the second nozzle are disposed in the same chamber, the first nozzle aerosolizes tin oxide particles and blows the aerosolized tin oxide particles on a stainless steel substrate at a first particle velocity V1, and then the second nozzle aerosolizes tin oxide particles and blows the aerosolized tin oxide particles on the stainless steel substrate at a second particle velocity V2 higher than the first particle velocity V1.

With such a configuration, blowing the tin oxide particles by the first nozzle removes the passive state film of the stainless steel substrate. Then, the second nozzle blows the tin oxide particles so that a tin oxide film is formed on the stainless steel substrate. Both of the removal of the passive state film and the forming of the tin oxide film are carried out similarly by blowing the tin oxide particles. Accordingly, it is easy to remove the passive state film and form the tin oxide film successively in the same chamber. Therefore, after the removal of the passive state film, the cost and the time for production can be reduced while a surface of the stainless steel substrate is prevented from oxidizing.

The present disclosure can reduce a cost and a time for production.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be explained hereinafter in detail with reference to the drawings. However, the present disclosure is not limited to the embodiments shown below. Further, for clarifying the explanation, the following descriptions and the drawings are simplified as appropriate.

First Embodiment

Figure 1:
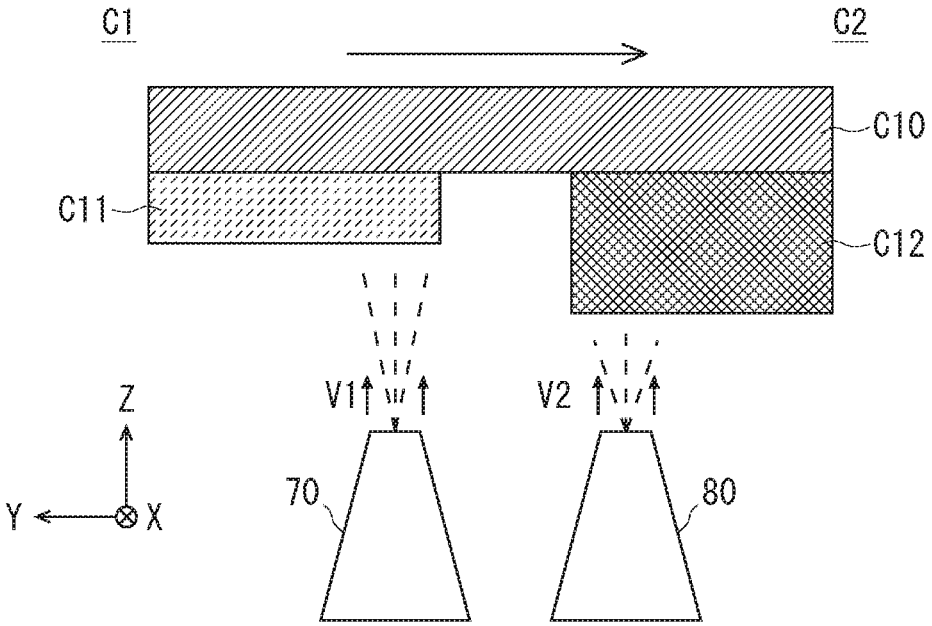
FIG. 1 is a schematic diagram showing a surface treatment method according to a first embodiment.
Figure 2:
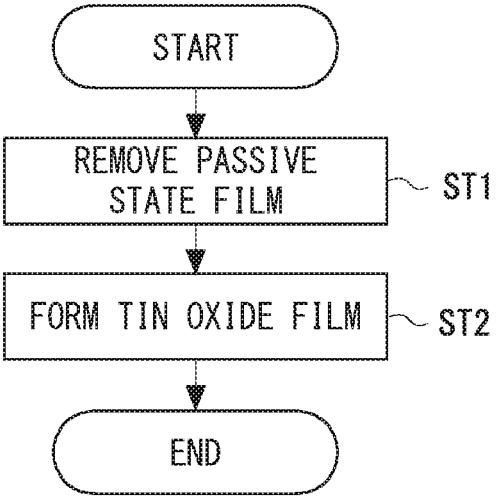
FIG. 2 is a flowchart showing the surface treatment method according to the first embodiment.

A surface treatment method according to a first embodiment is described with reference to FIGS. 1 and 2. FIG. 1 is a schematic diagram showing the surface treatment method according to the first embodiment. FIG. 2 is a flowchart showing the surface treatment method according to the first embodiment. As a matter of course, the right-handed xyz coordinates shown in FIG. 1 and other drawings are shown only for the sake of convenience to explain positional relations among components. Normally, the z-axis positive direction is a vertically upward direction, and the xy-plane is a horizontal plane, which direction and plane are the same throughout the drawings.

Prior to carrying out the surface treatment method, a stainless steel substrate C10 is conveyed from an upstream side C1 toward the downstream side C2 (in this example, the Y-axis negative side) in the conveying direction as shown in FIG. 1. The stainless steel substrate C10 is a substrate made of stainless steel. Immediately after being conveyed from the upstream side C1, the surface of the stainless steel substrate C10 is covered with a passive state film C11. A first nozzle 70 and a second nozzle 80 are disposed so as to face the stainless steel substrate C10, and the second nozzle 80 is disposed closer to the downstream side C2 than the first nozzle 70 is.

First, tin oxide particles are aerosolized to be blown on the stainless steel substrate C10 from the first nozzle 70 at a first particle velocity V1 (passive state film removal step ST1). These blown tin oxide particles come into contact with the passive state film C11 to remove it from the surface of the stainless steel substrate C10.

Further, tin oxide particles are aerosolized to be blown on the stainless steel substrate C10 by the second nozzle 80 at a second particle velocity V2 (tin oxide film forming step ST2). These blown tin oxide particles come into direct contact with the surface of the stainless steel substrate C10 from which the passive state film C11 has just been removed. As a result of this removal, a tin oxide film C12 is formed on the surface of the stainless steel substrate C10. The second particle velocity V2 is higher than the first particle velocity V1.

As described above, after the passive state film C11 is removed from the surface of the stainless steel substrate C10 by blowing the tin oxide particles, the tin oxide film C12 is further formed thereon. That is, both of the removal of the passive state film C11 and the forming of the tin oxide film C12 are carried out similarly by blowing the tin oxide particles, and thereby they can be successively, easily carried out in the same chamber. Accordingly, the cost and the time for production can be reduced while oxidizing of the surface of the stainless steel substrate C10 after the removal of the passive state film C11 is prevented.

(Surface Treatment Apparatus)

Figure 3:
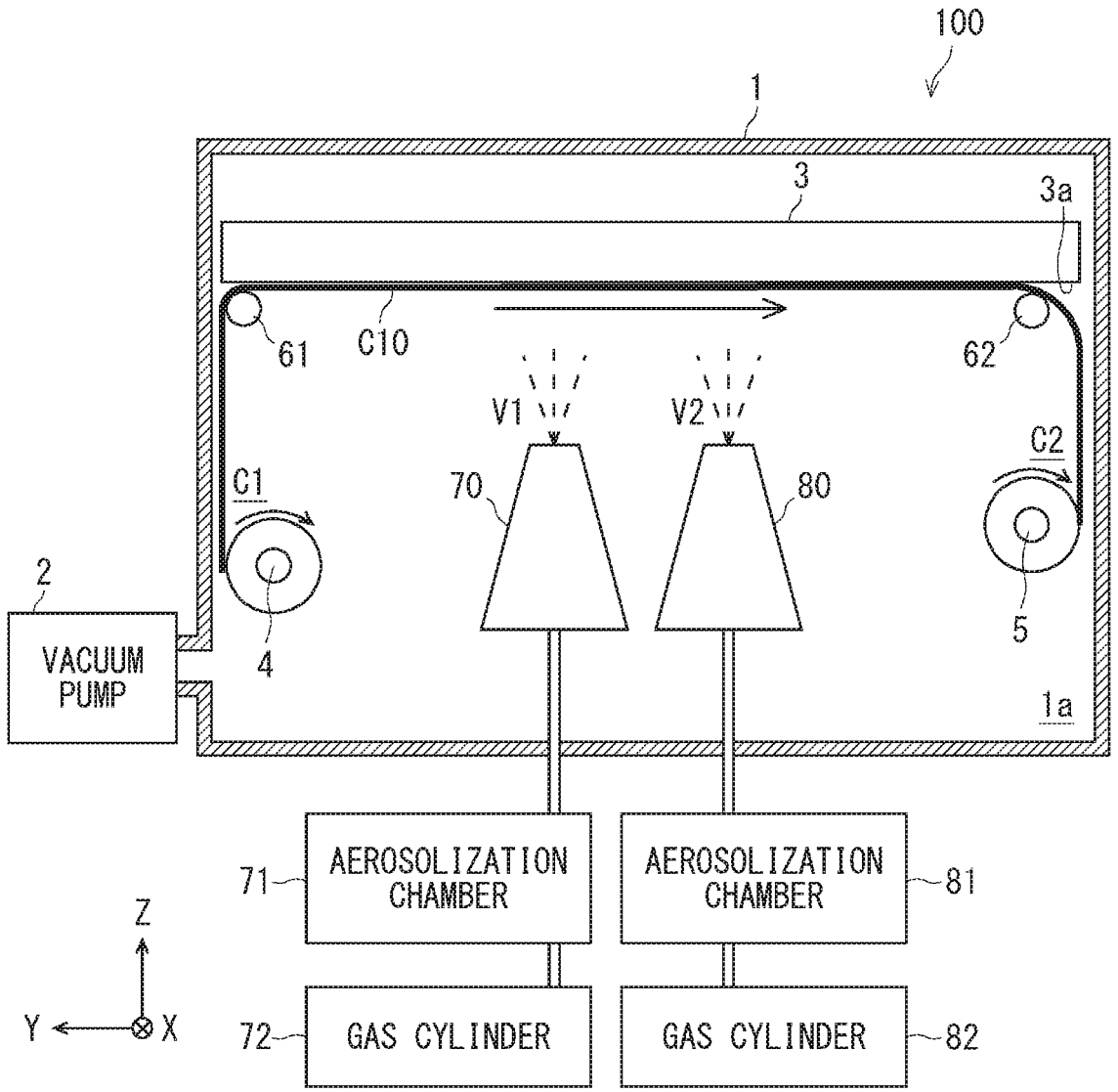
FIG. 3 is a schematic diagram showing a surface treatment apparatus according to the first embodiment.

Next, a surface treatment apparatus according to the first embodiment is described with reference to FIG. 3. FIG. 3 is a schematic diagram showing the surface treatment apparatus according to the first embodiment. The surface treatment apparatus according to the first embodiment can be used in the surface treatment method according to the first embodiment.

As shown in FIG. 3, a surface treatment apparatus 100 includes a low-pressure chamber 1, a vacuum pump 2, a substrate conveying table 3, a delivering shaft 4, a winding shaft 5, the first nozzle 70, and the second nozzle 80.

The low-pressure chamber 1 has a predetermined airtightness, and an internal space 1*a* of the low-pressure chamber 1 is isolated from the outer space thereof. The vacuum pump 2 is provided on the side wall of the low-pressure chamber 1. The substrate conveying table 3, the delivering shaft 4, the winding shaft 5, the first nozzle 70, and the second nozzle 80 are disposed in the internal space 1*a* of the low-pressure chamber 1.

The vacuum pump 2 discharges gas which the internal space 1*a* of the low-pressure chamber 1 is filled with to the outer space thereof as appropriate. This gas may be an inert gas, for example, a nitrogen gas. The vacuum pump 2 reduces a pressure in the internal space 1*a* of the low-pressure chamber 1 as compared with a pressure in the outer space of the low-pressure chamber 1. Further, the vacuum pump 2 can maintain the pressure in the internal space 1*a* of the low-pressure chamber 1 within a predetermined range.

The delivering shaft 4 and the winding shaft 5 are disposed with a predetermined space therebetween. At least one end of the stainless steel substrate C10 is wound around the delivering shaft 4. At least the other end of the stainless steel substrate C10 is wound around the winding shaft 5.

The substrate conveying table 3 includes a conveying surface 3*a* for conveying a workpiece W1, and the conveying surface 3*a* extends to move, for example, in one direction (in this example, the Y-axis direction). The substrate conveying table 3 is, for example, a belt conveyor. The substrate conveying table 3 is disposed at a predetermined distance from the delivering shaft 4 and the winding shaft 5. A substrate support roller 61 is provided so as to be able to rotate in the vicinity of an end on the side of the delivering shaft 4 in the substrate conveying table 3. The substrate support roller 61 and the substrate conveying table 3 sandwich the stainless steel substrate C10. A substrate support roller 62 is provided so as to be able to rotate in the vicinity of an end on the side of the winding shaft 5 in the substrate conveying table 3. The substrate support roller 62 and the substrate conveying table 3 sandwich the stainless steel substrate C10. The delivering shaft 4 and the winding shaft 5 rotate in a clockwise direction to convey the workpiece W1.

The first nozzle 70 is connected to an aerosolization chamber 71, and the aerosolization chamber 71 is connected to a gas cylinder 72. In an example shown in FIG. 3, the aerosolization chamber 71 and the gas cylinder 72 are disposed outside the low-pressure chamber 1.

The gas cylinder 72 stores a predetermined kind of gas. Such gas includes a wide variety of gases, for example, a nitrogen gas, and dry air. Such gas preferably has a low content of oxygen because the surface of the stainless steel substrate C10 is less likely to oxidize in that case. Accordingly, a nitrogen gas is preferable to dry air because the surface of the stainless steel substrate C10 is less likely to oxidize in that case.

Note that a compressor may be connected to the aerosolization chamber 71 to supply air. In this case, when a solid removing filter is provided between the compressor and the aerosolization chamber 71, floating solids in the atmosphere are stopped by the solid removing filter and cannot reach the tin oxide film. This prevents the tin oxide film from being contaminated by the floating solids, which is preferable.

The aerosolization chamber 71 may be provided with tin oxide particles, and such tin oxide particles are, for example, antimony-doped tin oxide particles. A particle diameter of such tin oxide particles is preferably a size within a predetermined range, and is, for example, 10 nm. Further, the aerosolization chamber 71 is preferably filled with the tin oxide particles after vacuum drying.

The gas cylinder 72 supplies gas to the aerosolization chamber 71, and the aerosolization chamber 71 aerosolizes the tin oxide particles by the supplied gas and supplies the aerosolized tin oxide particles to the first nozzle 70. The first nozzle 70 blows the aerosolized tin oxide particles at the first particle velocity V1. The first particle velocity V1 can be changed appropriately, for example, by adjusting the pressure in the internal space 1*a* of the low-pressure chamber 1 or a distance between the first nozzle 70 and the stainless steel substrate C10. The kinetic energy of the tin oxide particles blown by the first nozzle 70 can also be changed by changing the first particle velocity V1.

The second nozzle 80 is disposed closer to the downstream side C2 than the first nozzle 70 is. The second nozzle 80 is connected to an aerosolization chamber 81, and the aerosolization chamber 81 is connected to a gas cylinder 82. In an example shown in FIG. 3, the aerosolization chamber 81 and the gas cylinder 82 are disposed outside the low-pressure chamber 1.

The gas cylinder 82 preferably has the same configuration as that of the gas cylinder 72. The gas stored in the gas cylinder 82 also preferably has the same configuration as that of the gas stored in the gas cylinder 72. A gas pressure in the gas cylinder 82 is higher than that in the gas cylinder 72. Further, like the gas cylinder 72, the compressor may be connected to the aerosolization chamber 81 to supply air. Further, in this case, the solid removing filter is preferably provided between the compressor and the aerosolization chamber 81 for the same reason as that in the above-described case where the solid removing filter is provided between the compressor and the aerosolization chamber 71.

The aerosolization chamber 81 preferably has the same configuration as that of the aerosolization chamber 71. The tin oxide particles provided in the aerosolization chamber 81 also preferably has the same configuration as that of the tin oxide particles provided in the aerosolization chamber 71.

The gas cylinder 82 supplies gas to the aerosolization chamber 81, and the aerosolization chamber 81 aerosolizes the tin oxide particles by the supplied gas and supplies the aerosolized tin oxide particles to the second nozzle 80. The second nozzle 80 blows the aerosolized tin oxide particles at the second particle velocity V2. The second particle velocity V2 is higher than the first particle velocity V1. Therefore, the gas pressure in the gas cylinder 82 is preferably higher than that in the gas cylinder 72. The second particle velocity V2 can be changed appropriately, for example, by adjusting the pressure in the internal space 1*a* of the low-pressure chamber 1 or a distance between the second nozzle 80 and the stainless steel substrate C10. The kinetic energy of the tin oxide particles blown by the second nozzle 80 can also be changed by changing the second particle velocity V2. (A specific example of the surface treatment method according to the first embodiment)

Figure 4:
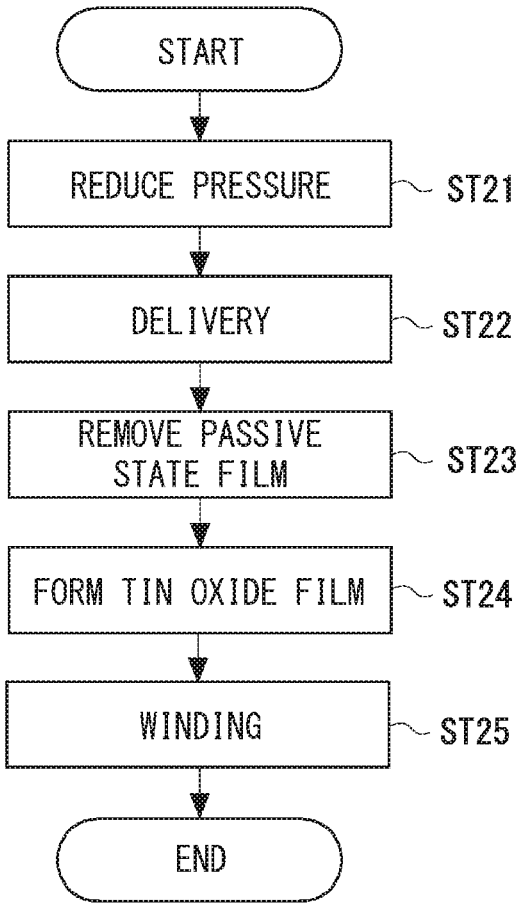
FIG. 4 is a flowchart showing a specific example of the surface treatment method according to the first embodiment.

Next, a specific example of the surface treatment method according to the first embodiment is described with reference to FIGS. 3 and 4. FIG. 4 is a flowchart showing the specific example of the surface treatment method according to the first embodiment. The specific example of the surface treatment method according to the first embodiment can be carried out by using the surface treatment apparatus 100.

First, the vacuum pump 2 discharges gas from the internal space 1*a* of the low-pressure chamber 1 to the outer space to reduce a gas pressure in the internal space 1*a* of the low-pressure chamber 1 to within a predetermined range (pressure reduction step ST21). Then, the vacuum pump 2 maintains the gas pressure in the internal space 1*a* of the low-pressure chamber 1 within a predetermined range. The gas pressure in the internal space 1*a* of the low-pressure chamber 1 is lower than that in the outer side of the low-pressure chamber 1.

Next, the delivering shaft 4 and the winding shaft 5 are rotated in a predetermined direction to convey the stainless steel substrate C10 from the delivering shaft 4 to the winding shaft 5 (delivering step ST22). Note that from the delivering step ST22 to a winding step ST25, steps carried out in a part of the stainless steel substrate C10 are described in order, and they can be simultaneously, continuously carried out in the whole stainless steel substrate C10.

Next, tin oxide particles are aerosolized to be blown on the stainless steel substrate C10 from the first nozzle 70 at the first particle velocity V1 (passive state film removal step ST23). These blown tin oxide particles come into contact with the passive state film C11 to remove it from the stainless steel substrate C10. Note that the vacuum pump 2 may suction the tin oxide particles, which have come into contact with the passive state film, and the removed passive state film C11 so that they are removed from the internal space 1*a* of the low-pressure chamber 1.

Next, tin oxide particles are aerosolized to be blown on the stainless steel substrate C10 from the second nozzle 80 at the second particle velocity V2 (tin oxide film forming step ST24). These blown tin oxide particles come into direct contact with the surface of the stainless steel substrate C10 to form the tin oxide film C12 thereon. The second particle velocity V2 is higher than the first particle velocity V1.

Then, the winding shaft 5 winds the stainless steel substrate C10 on which the tin oxide film C12 has been formed (winding step ST25).

As described above, after the passive state film C11 is removed from the surface of the stainless steel substrate C10 by blowing the tin oxide particles, the tin oxide film C12 is further formed thereon. That is, both of the removal of the passive state film C11 and the forming of the tin oxide film C12 are carried out similarly by blowing the tin oxide particles, and thereby they can be successively, easily carried out in the same low-pressure chamber 1. Accordingly, the cost and the time for production can be reduced while oxidizing of the surface of the stainless steel substrate C10 after the removal of the passive state film C11 is prevented.

EXAMPLE

Experiment 1

Figure 5:
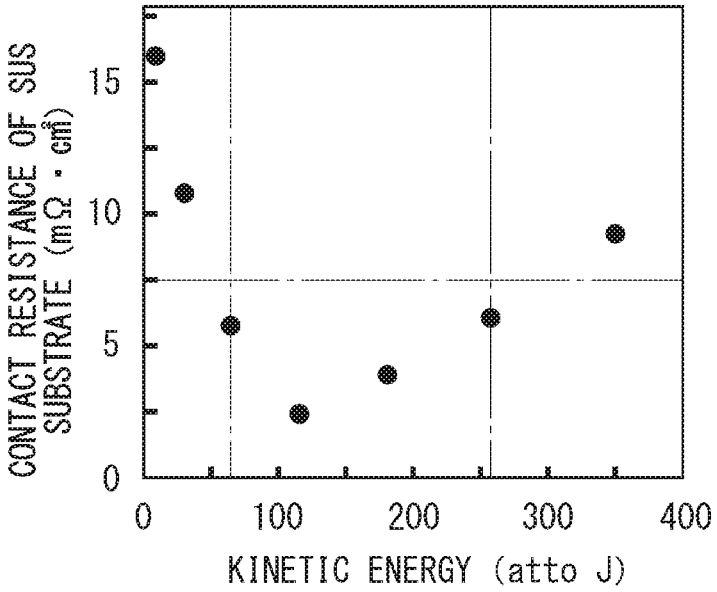
FIG. 5 is a graph showing a contact resistance of a SUS substrate to a kinetic energy.
Figure 6:
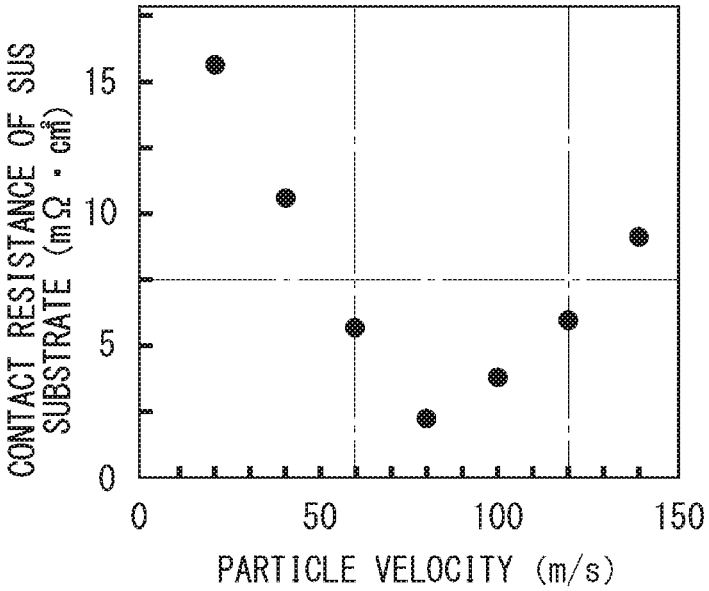
FIG. 6 is a graph showing a contact resistance of a SUS substrate to a particle velocity.

Next, an experiment which was carried out by using a specific example of the above-described surface treatment method according to the first embodiment is described with reference to FIGS. 5 and 6. FIG. 5 is a graph showing a contact resistance of a SUS substrate to a kinetic energy. FIG. 6 is a graph showing a contact resistance of a SUS substrate to a particle velocity. Note that the graph shown in FIG. 6 has the same graph form as that in FIG. 5 except that the horizontal axis is replaced from the kinetic energy to the particle velocity.

As the stainless steel substrate C10, a coil (a SUS substrate) having a thickness of 0.1 mm and made of SUS447 was used. As tin oxide particles, antimony-doped tin oxide particles ("T-1" manufactured by Mitsubishi Materials Corporation and commercially available) each having a particle diameter of 10 nm were used. The kinetic energy of the antimony-doped tin oxide particles was calculated by using the weight and the velocity thereof. The weight of the antimony-doped tin oxide particles was calculated by using the diameter thereof and the density of the antimony-doped tin oxide particles which has been known. The velocity of the particles was analyzed by using a thermal spray state analyzer which is commercially available. This thermal spray state analyzer can analyze a state of thermal spraying by using a camera and a personal computer.

The steps from the pressure reduction step ST21 to the passive state film removal step ST23 in the specific example of the above-described surface treatment method were carried out, and an example of the stainless steel substrate C10 from which the passive state film C11 was removed was formed. In a step corresponding to the passive film removal step ST23, a plurality of levels were set to the kinetic energy of tin oxide particles blown from a nozzle corresponding to the first nozzle 70 within a range between approximately 0 and 400 atto J. Note that when this kinetic energy in a range between approximately 0 and 400 atto J is converted into the particle velocity, the converted kinetic energy corresponds to the particle velocity within a range between approximately 0 and 150 m/sec.

In order to confirm that the passive state film C11 was removed, a contact resistance of the example of the stainless steel substrate C10 from which this passive state film C11 was removed was measured. Specifically, first, a carbon paper ("TGP-H-120" manufactured by Toray Industries, Inc. and commercially available) was sandwiched between the surface of this stainless steel substrate from which the passive state film was removed and a copper plate plated with gold, and then a pressure was applied thereon at a pressure value of 0.98 MPa. Further, when a constant current was applied between the stainless steel substrate and the copper plate while the pressure was applied, a voltage value between the surface of the stainless steel substrate and the carbon paper was measured. The contact resistance was obtained based on this measured voltage value, which is shown in FIG. 5. The kinetic energy of the tin oxide particles was converted into the particle velocity, which is shown in FIG. 6. It was determined here that when the contact resistance was 7.5 $m\Omega \cdot cm^2$ or lower, the passive state film was sufficiently removed, and that when the contact resistance was higher than 7.5 $m\Omega \cdot cm^2$, the passive state film was not sufficiently removed.

As shown in FIG. 5, in a step corresponding to the passive state film removal step ST23, when the kinetic energy of the tin oxide particles blown by the nozzle corresponding to the first nozzle 70 was less than 70 atto J or was higher than 260 atto J, the contact resistance was higher than 7.5 $m\Omega \cdot cm^2$, and thus the passive state film was determined to be not sufficiently removed. On the other hand, when the kinetic energy of the tin oxide particles was 70 atto J or higher and was 260 atto J or lower, the contact resistance was 7.5 $m\Omega \cdot cm^2$ or lower, and thus the passive state film was determined to be sufficiently removed. Therefore, the kinetic energy of the tin oxide particles are preferably in a range of 70 atto J or higher and 260 atto J or lower since the passive state film can then be removed sufficiently.

Further, as shown in FIG. 6, when the particle velocity of the tin oxide particles was less than 60 m/sec or was higher than 120 m/sec, the contact resistance was higher than 7.5 $m\Omega \cdot cm^2$, and thus the passive state film was determined to be not sufficiently removed. On the other hand, when the particle velocity of the tin oxide particles was 60 m/sec or higher and was 120 m/sec or lower, the contact resistance was 7.5 $m\Omega \cdot cm^2$ or lower, and thus the passive state film was determined to be sufficiently removed. Therefore, the particle velocity of the tin oxide particles are preferably in a range of 60 m/sec or higher and 120 m/sec or lower because the passive state film can be then removed sufficiently.

Experiment 2

Figure 7:
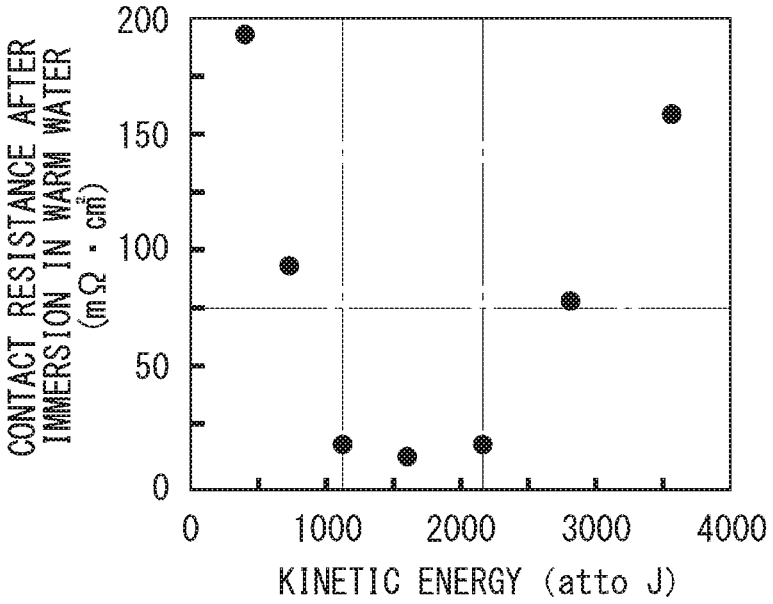
FIG. 7 is a graph showing a contact resistance to a kinetic energy after immersion in warm water.
Figure 8:
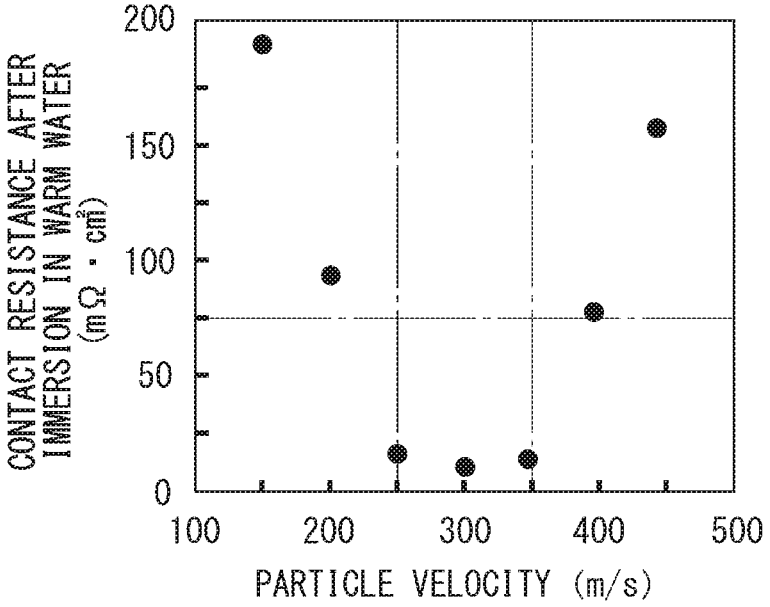
FIG. 8 is a graph showing the contact resistance to the particle velocity after immersion in warm water.

Next, another experiment which was carried out by using the specific example of the above-described surface treatment method according to the first embodiment is described with reference to FIGS. 7 and 8. FIG. 7 is a graph showing a contact resistance to the kinetic energy after immersion in warm water. FIG. 8 is a graph showing a contact resistance to the particle velocity after immersion in warm water. Note that the graph shown in FIG. 8 has the same graph form as that in FIG. 7 except that the horizontal axis is replaced from the kinetic energy to the particle velocity.

Further, the steps from the pressure reduction step ST21 to the tin oxide film forming step ST24 in the specific example of the above-described surface treatment method were carried out, and an example of the stainless steel substrate C10, on which the tin oxide film C12 was formed, was formed. In a step corresponding to the tin oxide film forming step ST24, a plurality of levels were set to the kinetic energy of tin oxide particles blown from a nozzle corresponding to the second nozzle 80 within a range between approximately 400 to 4000 atto J. Note that when this kinetic energy in a range between approximately 400 and 4000 atto J is converted into the particle velocity, the converted kinetic energy corresponds to the particle velocity within a range between approximately 150 and 500 m/sec.

In order to evaluate a conductivity of the tin oxide film C12, a contact resistance of the example of the stainless steel substrate C10 on which the tin oxide film C12 was formed was measured. Specifically, first, a warm water immersion test in which a test piece according to the example of the stainless steel substrate C10 is immersed in ion-exchanged water at 80° C. for 100 hours was carried out. After this warm water immersion test was carried out, a carbon paper was sandwiched between the surface of the example of the stainless steel substrate C10 on which the tin oxide film was formed and a copper plate plated with gold, and then a pressure was applied thereon at a pressure value of 0.98 Mpa. Further, when a constant current was applied between the stainless steel substrate and the copper plate while the pressure was applied, a voltage value between the surface of the stainless steel substrate and the carbon paper was measured. The contact resistance was obtained based on this measured voltage value, and this contact resistance to the kinetic energy of the tin oxide particles is shown in FIG. 7. The kinetic energy of the tin oxide particles was converted into the particle velocity, and this contact resistance to the particle velocity of the tin oxide particles is shown in FIG. 8. Note that it was determined in the example of the stainless steel substrate C10 that when the contact resistance was 7.5 $m\Omega \cdot cm^2$ or lower, the conductivity of the tin oxide film was favorable, and that when the contact resistance was higher than 7.5 $m\Omega \cdot cm^2$, the conductivity of the tin oxide film was poor.

As shown in FIG. 7, in a step corresponding to the tin oxide film forming step ST24, there are cases in which the kinetic energy of the tin oxide particles blown from the nozzle corresponding to the second nozzle 80 was less than 1100 atto J or was higher than 2200 atto J. In such cases, the contact resistance is higher than 7.5 $m\Omega \cdot cm^2$, and thus the conductivity of the tin oxide film was determined to be poor. On the other hand, when the kinetic energy of the tin oxide particles was 1100 atto J or higher and was 2200 atto J or lower, the contact resistance was 7.5 $m\Omega \cdot cm^2$ or lower, and thus the conductivity of the tin oxide film was determined to be favorable. Therefore, the kinetic energy of the tin oxide particles are preferably in a range of 1100 atto J or higher and 2200 atto J or lower because the conductivity of the tin oxide film is favorable.

Further, as shown in FIG. 8, there are cases where the particle velocity of the tin oxide particles was less than 250 m/sec or was higher than 350 m/sec. In such cases, the contact resistance is higher than 7.5 mΩ·cm$^2$, and thus the conductivity of the tin oxide film was determined to be poor. On the other hand, when the particle velocity of the tin oxide particles was 250 m/sec or higher and was 350 m/sec or lower, the contact resistance was 7.5 mΩ·cm$^2$ or lower, and thus the conductivity of the tin oxide film was determined to be favorable. Therefore, the particle velocity of the tin oxide particles are preferably in a range of 250 m/sec or higher and 350 m/sec or lower because the conductivity of the tin oxide film is favorable.

Note that the present disclosure is not limited to the above-described embodiment. Changes can be made to the present disclosure without departing from the spirit of the invention.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A surface treatment method, comprising:

while a first nozzle and a second nozzle are disposed in an internal space, of a same low-pressure chamber, that has a gas pressure lower than an outside of the low-pressure chamber, blowing, with the first nozzle, aerosolized tin oxide particles on a stainless steel substrate at a first particle velocity V1, and then blowing, with the second nozzle, aerosolized tin oxide particles on the stainless steel substrate at a second particle velocity V2 higher than the first particle velocity V1, wherein a kinetic energy of the tin oxide particles blown by the second nozzle is between 1100 and 2200 atto J.

2. The surface treatment method according to claim 1, wherein a kinetic energy of the tin oxide particles blown by the first nozzle is between 70 and 260 atto J.

3. A surface treatment apparatus comprising a first nozzle and a second nozzle, wherein while the first nozzle and the second nozzle are disposed in an internal space, of a same low-pressure chamber, that has a gas pressure lower than an outside of the low-pressure chamber, the first nozzle is configured to blow aerosolized tin oxide particles on a stainless steel substrate at a first particle velocity V1, and then the second nozzle is configured to blow aerosolized tin oxide particles on the stainless steel substrate at a second particle velocity V2 higher than the first particle velocity V1, and the second nozzle is configured to blow the aerosolized tin oxide particles such that the aerosolized tin oxide particles have a kinetic energy between 1100 and 2200 atto J.

* * * * *